US007527502B2

(12) United States Patent
Li

(10) Patent No.: US 7,527,502 B2
(45) Date of Patent: May 5, 2009

(54) ELECTRICAL CONTACT ASSEMBLY AND CONNECTOR SYSTEM

(76) Inventor: Che-Yu Li, 5 Oakridge La., Roslyn, NY (US) 11576

( * ) Notice: Subject to any disclaimer, the term of this patent is extended or adjusted under 35 U.S.C. 154(b) by 0 days.

(21) Appl. No.: 11/264,803

(22) Filed: Nov. 1, 2005

(65) Prior Publication Data

US 2007/0099445 A1 May 3, 2007

(51) Int. Cl.
*H01R 12/00* (2006.01)

(52) U.S. Cl. ..... 439/70

(58) Field of Classification Search ..... 439/70, 439/71, 73, 509, 68–69, 700, 482
See application file for complete search history.

(56) References Cited

U.S. PATENT DOCUMENTS

| | | | | |
|---|---|---|---|---|
| 2,153,177 | A | 4/1939 | Ecker | |
| 3,317,885 | A | 5/1967 | Yost | |
| 3,513,434 | A | 5/1970 | Zielke | |
| 3,795,884 | A | 3/1974 | Kotaka | |
| 3,895,616 | A * | 7/1975 | Steinke | 123/406.73 |
| 4,029,375 | A | 6/1977 | Gabrielian | |
| 4,810,213 | A | 3/1989 | Chabot | |
| 4,820,376 | A | 4/1989 | Lambert et al. | |
| 4,838,815 | A | 6/1989 | Tajima et al. | |
| 4,922,376 | A | 5/1990 | Pommer et al. | |
| 5,030,109 | A | 7/1991 | Dery | |
| 5,041,017 | A * | 8/1991 | Nakazato et al. | 439/509 |
| 5,061,191 | A | 10/1991 | Casciotti et al. | |
| 5,199,456 | A * | 4/1993 | Love et al. | 137/270 |
| 5,232,372 | A | 8/1993 | Bradley et al. | |
| 5,473,510 | A | 12/1995 | Dozier, II | |
| 6,625,280 | B1 * | 9/2003 | Kerr et al. | 379/412 |
| 6,798,228 | B2 * | 9/2004 | Cuevas | 324/755 |
| 6,821,131 | B2 * | 11/2004 | Suzuki et al. | 439/73 |
| 7,126,062 | B1 * | 10/2006 | Vinther et al. | 174/260 |
| 7,140,916 | B2 * | 11/2006 | Sweetland | 439/595 |

OTHER PUBLICATIONS

IBM, Electrical Noise Alternative, Oct. 1976, vol. 19, 1534-1535.*

* cited by examiner

*Primary Examiner*—Jean F Duverne
(74) *Attorney, Agent, or Firm*—Brown + Michaels, PC

(57) ABSTRACT

A connector system is provided including a housing defining a plurality of through openings. A plurality of electrical contact assemblies, each including at least one torsion spring supported upon a conductive mandrel are arranged so that one electrical contact assembly is positioned within a corresponding one through opening such that each of the mandrels is lodged within a respective one of the through openings with portions of the torsion springs standing proud of the housing.

12 Claims, 17 Drawing Sheets

ELECTRICAL CONTACT ASSEMBLY AND CONNECTOR SYSTEM

FIELD OF THE INVENTION

The present invention generally relates to interconnection systems for high speed electronics systems, and more particularly to an electrical contact assembly and connector system that is adapted for use in electronic systems that are capable of high speed data transmission.

BACKGROUND OF THE INVENTION

High density integrated circuit (IC) packages that house LSI/VLSI type semiconductor devices are well known. Input/output contacts for such IC packages are often arranged in such a dense pattern (sometimes more than five hundred closely spaced contacts) that direct soldering of the IC package to a substrate, such as a printed wiring or circuit board (PCB) creates several significant problems related to inspection and correction of any resulting soldering faults as well as thermal expansion mismatch failures.

Land grid array (LGA) connectors are known for interconnecting IC packages to PCB's. LGA's typically do not require soldering procedures during engagement with the PCB. Referring to FIG. 1, prior art LGA assemblies are used to interconnect an IC package A having a plurality of contact pads or bumps B formed on a bottom surface, to contact pads C arranged in a regular pattern on a surface of printed wiring board or printed circuit board (PCB) D. Current technology permits conductive pads B and conductive pads C to be disposed at center-to-center spacings (as indicated by dimension "a" in FIG. 1) of approximately one half to one millimeter, with further miniaturization possible and inevitable.

Prior art LGA assemblies E are known which include an insulative housing and a plurality of resilient conductive contacts F received in passageways formed in the housing. The resilient conductive contacts typically have exposed portions at the upper and lower surfaces of the insulative housing for engaging flat contact pads B,C. When IC package A is accurately positioned in overlying aligned engagement with PCB D, such that conductive pads B engage conductive pads C, a normal force is applied to the exposed portions of each resilient conductive contact to electrically and mechanically engage the respective contact pads.

The resilient conductive contacts associated with prior art LGA's have had a variety of shapes. A commonly used form of resilient conductive contact includes two free ends connected by a curved portion which provides for the storage of elastic energy during engagement with the IC package and PCB. Prior art resilient conductive contacts are usually a single metal structure in the form of a spring to provide the required elastic response during service while also serving as a conductive element for electrical connection. Typically, a combination of barrier metal and noble metal platings is applied to the surface of the spring for corrosion prevention and for electrical contact enhancement. It is often the case that these platings are not of sufficient thickness for electrical conduction along the surface of the spring. Examples of such prior art resilient conductive contacts may be found in U.S. Pat. Nos.: 2,153,177; 3,317,885; 3,513,434; 3,795,884; 4,029,375; 4,810,213; 4,820,376; 4,838,815; 4,922,376; 5,030,109; 5,061,191; 5,232,372; and 5,473,510. The foregoing patents are hereby incorporated herein by reference.

A problem exists in the high density electrical interconnection art in that a good material for the construction of a spring, such as a high strength steel, is not a very good electrical conductor. On the other hand, a good electrical conductor, such as a copper alloy or precious metal, is often not a good spring material. There is a need for a simplified resilient conductive contact which incorporates the seemingly opposing requirements of good spring properties and high conductivity. Additionally, attributes, missing from the prior art that are necessary for a universally applicable electrical contact include: (i) extendibility to a large contact array at fine pitch, i.e., five mils or less and (ii) spring members of relatively small size but high elastic compliance, i.e., spring members capable of deflections in the elastic range of as much as thirty percent of their uncompressed or undeflected height, and with low contact force, i.e., less than twenty grams per contact. In addition, such a universally applicable electrical contact will be capable of high frequency transmittance of signals greater than 10 gigahertz, which would require a small self-inductance and therefore a short contact height. Also, a universally applicable electrical contact will be capable of high current capacity, i.e., having less than 10 milliohm bulk resistance per contact and low contact resistance. Furthermore, a universally applicable electrical contact will be capable of high durability or high cycles of touchdowns, i.e., greater than five hundred thousand cycles, which requires a spring having a high elastic compliance to avoid permanent set in contact height under repeated compressive loadings as well as high fatigue strength. Additionally, a universally applicable electrical contact will be capable of high reliability with minimum degradation in contact resistance which often requires a noble metal contact surface and redundancy in contact points. Also, a universally applicable electrical contact will be capable of high service temperatures, i.e., often exceeding two hundred and fifty degrees centigrade, which requires the structural part of the electrical contact to be made of high melting temperature metals to prevent the relaxation of contact force. All of the foregoing will be essential, but will only help solve the problems in the art if achieved with low cost manufacturing, using conventional high volume tools and processes.

Therefore, an improved electrical contact system and assembly for use in a wide variety of electrical connector and interface sockets and interposers is needed which can overcome the drawbacks of conventional electrical contacts and exhibit the foregoing attributes.

SUMMARY OF THE INVENTION

The present invention provides a connector system having a housing that has a plurality of through openings. A plurality of electrical contact assemblies is provided where each includes at least one torsion spring supported upon a conductive mandrel. Each of the plurality of electrical contact assemblies is arranged within a corresponding one of the plurality of through openings such that each of the conductive mandrels is lodged within a respective one of the through openings.

In another aspect of the invention an electrical contact assembly is provided that includes at least one torsion spring supported upon a conductive mandrel. The at least one torsion spring includes at least a one and one half turn wound section that is outwardly biased by the conductive mandrel, with a first free end and a second free end emerging from the wound section in a substantially cantilevered inclined disposition relative to the conductive mandrel.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
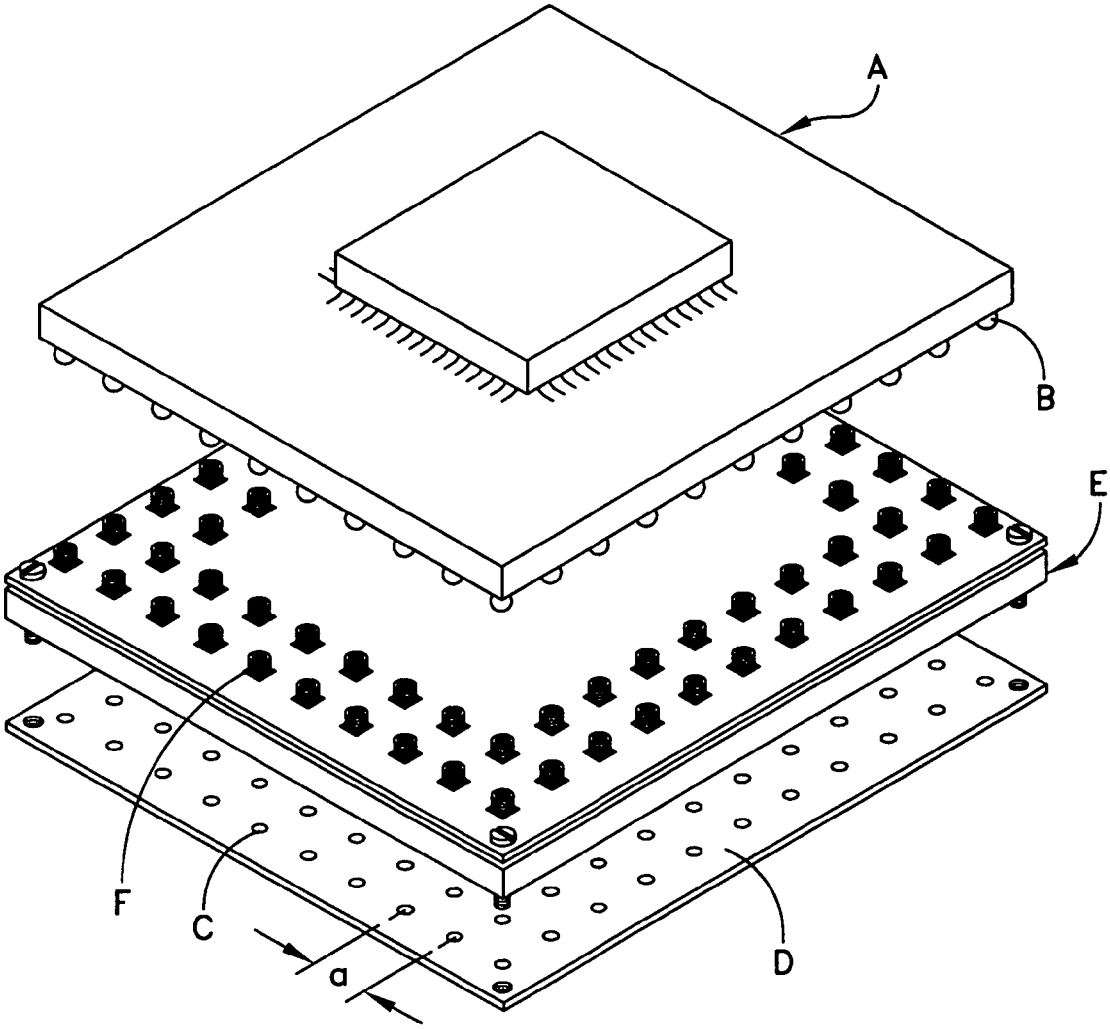
FIG. 1 (PRIOR ART)
FIG. 1 is an exploded perspective view of a prior art LGA assembly.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
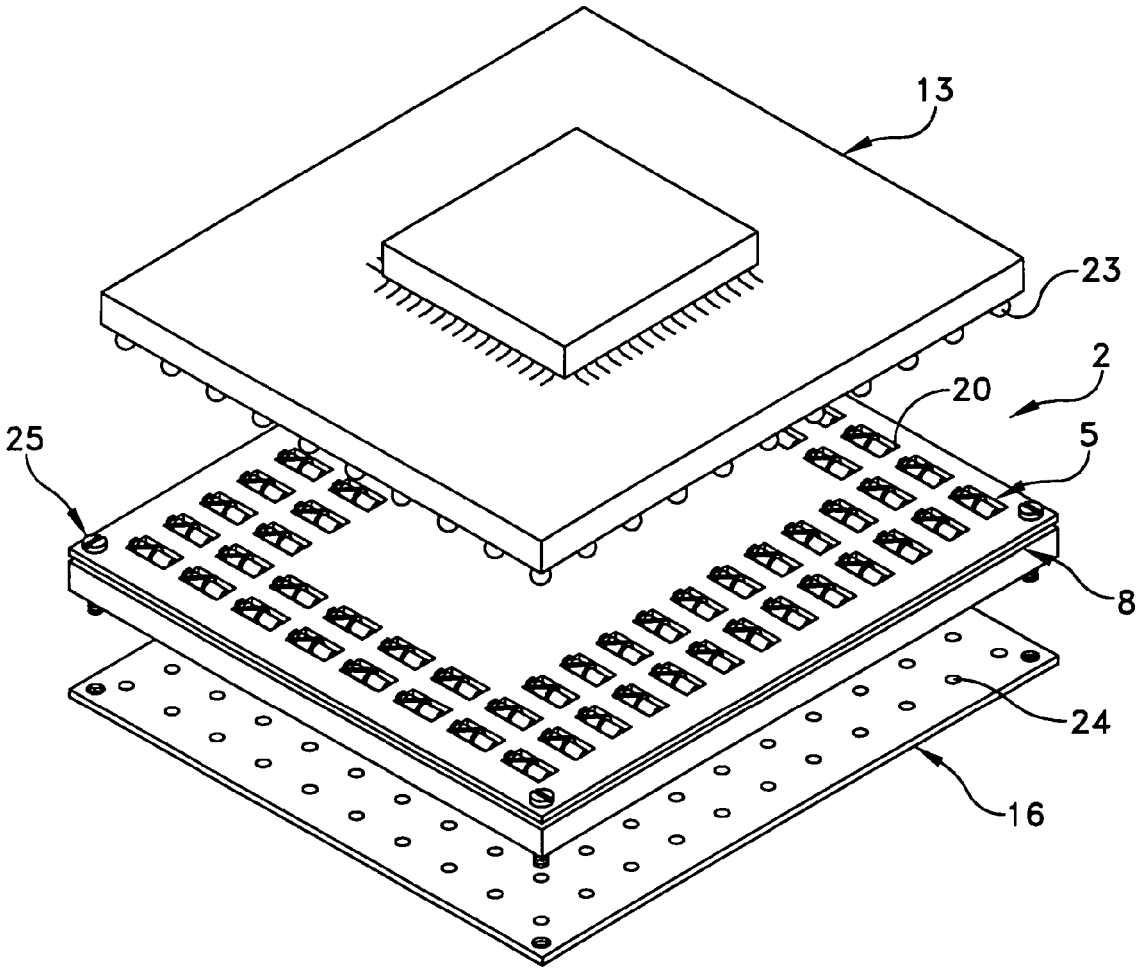
FIG. 2 is an exploded perspective view of a connector assembly formed in accordance with one embodiment of the present invention.

Referring to FIG. 2, a connector system 2 formed in accordance with the present invention comprises a plurality of electrical contact assemblies 5 assembled within a housing block 8 that is sized and shaped to effect an electrical interconnection between an integrated circuit package 13 to PCB 16. Housing block 8 includes a plurality of through openings or apertures 20 arranged in a grid or array that corresponds to the pattern of contact pads 23 located on the bottom surface of IC package 13 and also to the pattern of contact pads 24 that are located on either the top or bottom surface of PCB 16. The internal surface portions of housing block 8 that define each aperture 20 are each arranged, sized, and shaped so as to snugly receive and support an electrical contact assembly 5. Means for securely mounting housing block 8 to PCB 16 are also provided, and indicated generally at reference numeral 25. Any of the various polymeric materials useful in the electronics industry may be used in connection with housing block 8, including, without limitation, thermoplastics (crystalline or non-crystalline, cross-linked or non-cross-linked), thermosetting resins, elastomers or blends or composites thereof.

Figure 3:
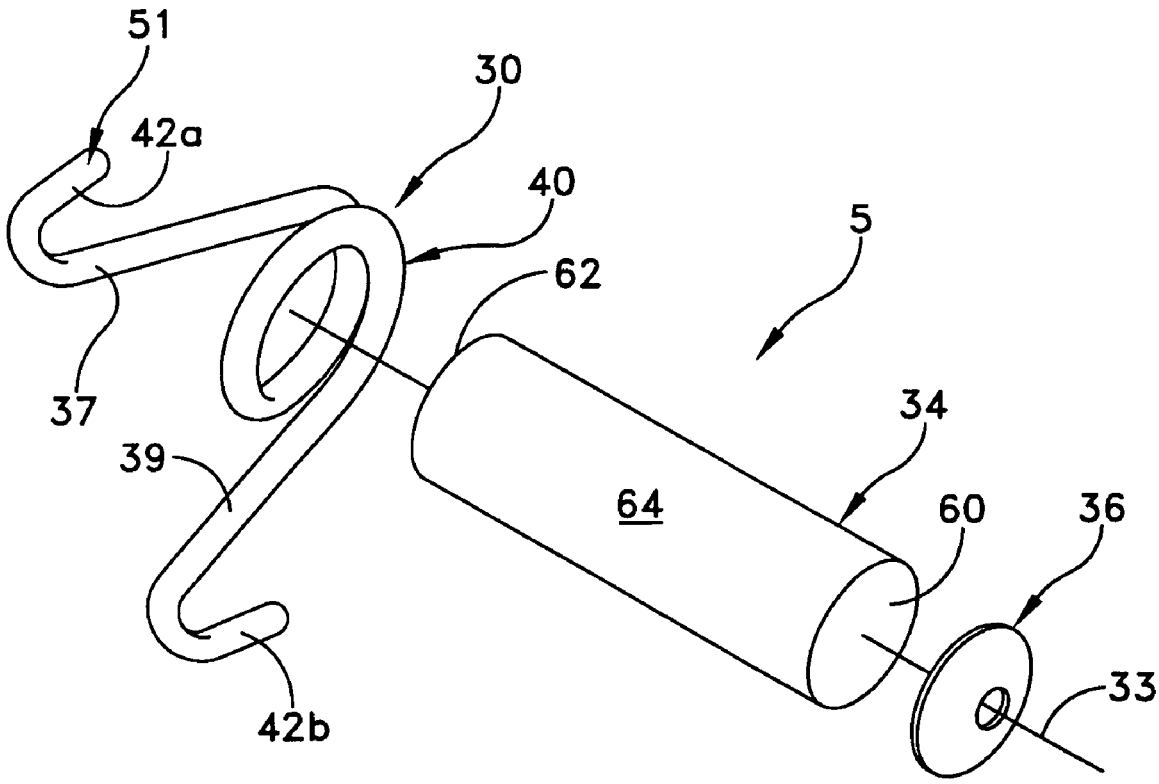
FIG. 3 is an exploded perspective view of an electrical contact assembly formed in accordance with one embodiment of the present invention.
Figure 4:
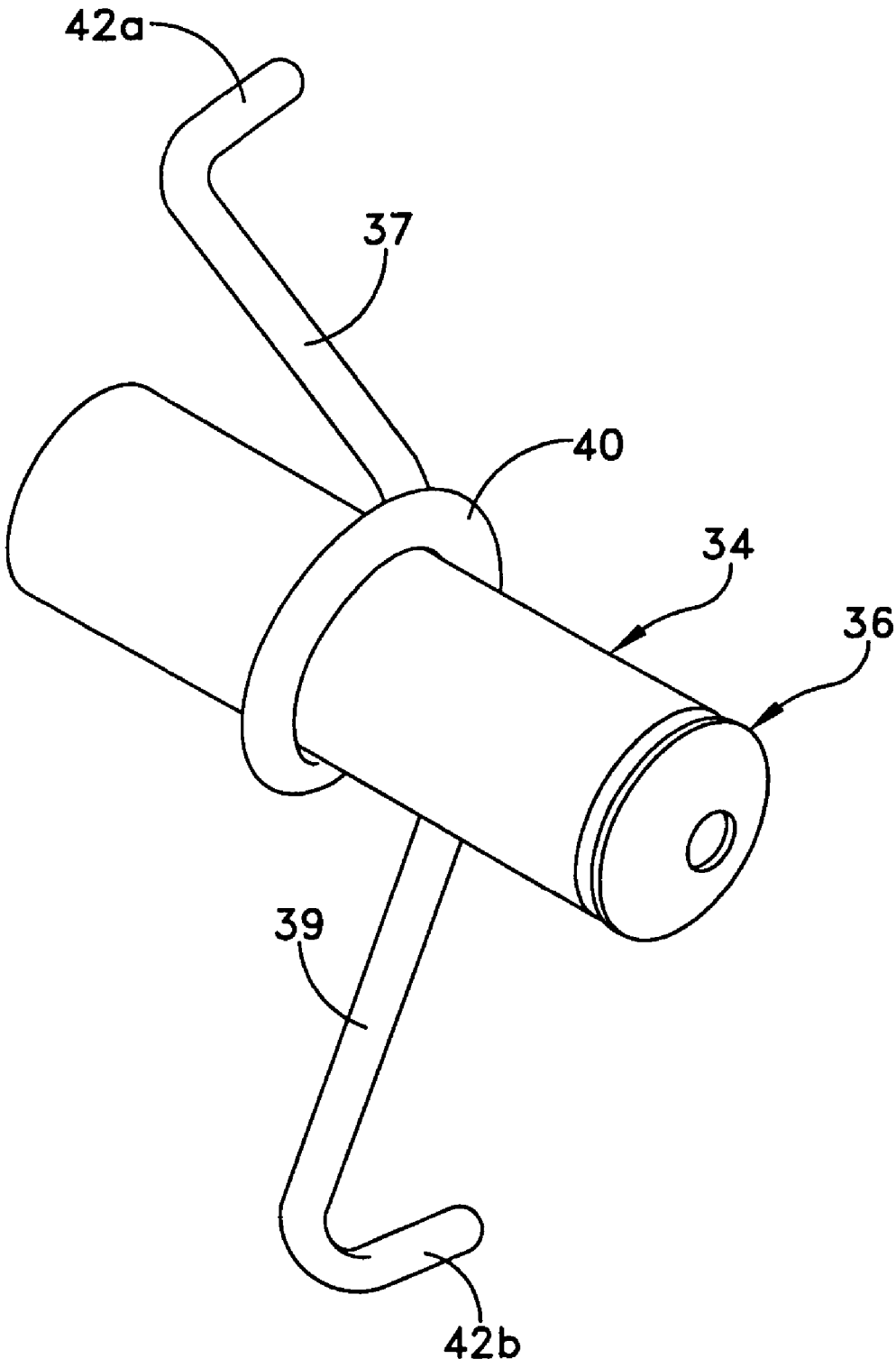
FIG. 4 is a perspective view of another embodiment of electrical contact assembly formed in accordance with the present invention.
Figure 5:
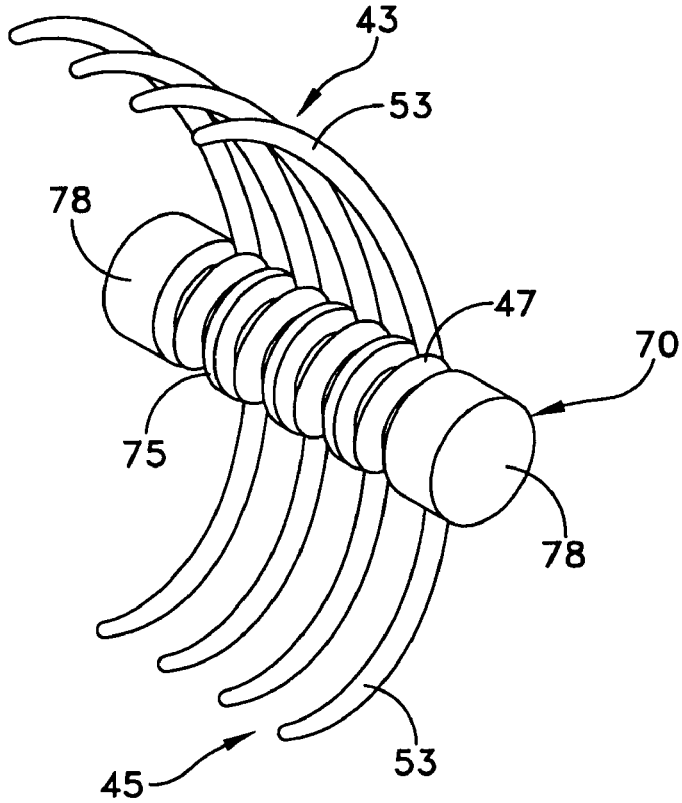
FIG. 5 is a perspective view of yet another embodiment of electrical contact assembly formed in accordance with the present invention.

Referring to FIGS. 3-5, electrical contact assemblies 5 each comprise one or more straight torsion springs 30 that are assembled to a mandrel 34, often with one or more resilient washers 36 located at each end of mandrel 34. More particularly, straight torsion spring 30 comprises at least a one and one half turn spring having a first free arm 37 and a second free arm 39 that emerge in divergingly spaced relation to one another from a wound section 40 so as to be at a substantially inclined disposition relative to the axis of wound section 40. Each free arm 37, 39 is cantilevered at the point along their respective lengths where each engages the outer surface of mandrel 34, as will hereinafter be more fully disclosed. Cantilevered arms 37, 39 often lie at an angle of about 30° to 75° relative to a horizontal plane passing through the longitudinal axis 33 of mandrel 34, and are freely emergent from wound section 40 (FIGS. 3 and 4). In preferred embodiments, cantilevered arms 37, 39 lie in substantially adjacent vertical planes so as to be off-set from one another along the longitudinal axis of mandrel 34.

A second cantilevered arm 42*a*, 42*b* having a contact pad interface portion 51 is often formed at a position that is spaced from wound section 40 along the length of each of cantilevered arms 37, 39 by placing a bend or "crook" in each cantilevered arm 37, 39. In this way, a compound cantilevered spring configuration is created by the combination of each cantilevered arm 37, 39 with its respective second cantilevered arm 42*a*, 42*b*. This structural arrangement provides for a relatively small size (i.e., relative to the center line spacing of contact pads 23 and contact pads 24, e.g., five mils or less) with a high but adjustable elastic compliance that allows for compressive deflections of as much as thirty percent of the undeflected or uncompressed height of each cantilevered arm 37, 39, and with low contact forces that are routinely less than twenty grams per electrical contact assembly.

Figure 6:
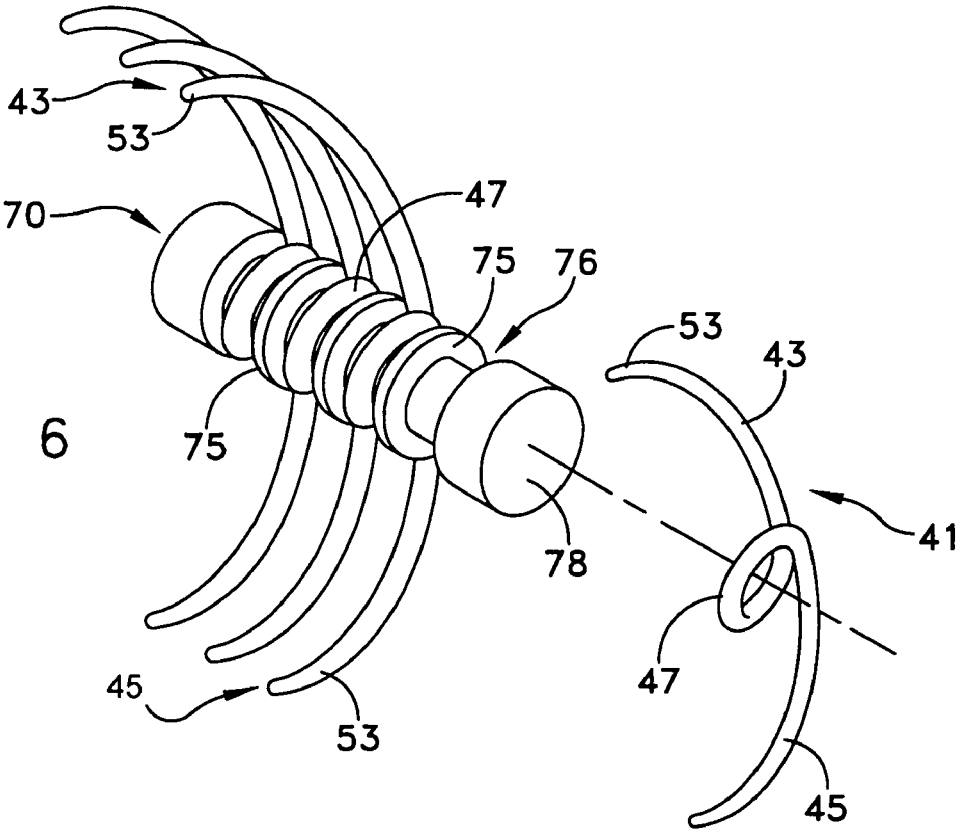
FIG. 6 is a perspective, exploded view of the electrical contact assembly shown in FIG. 5, with one electrical contact spaced away from an end of the mandrel for clarity of illustration.
Figure 7:
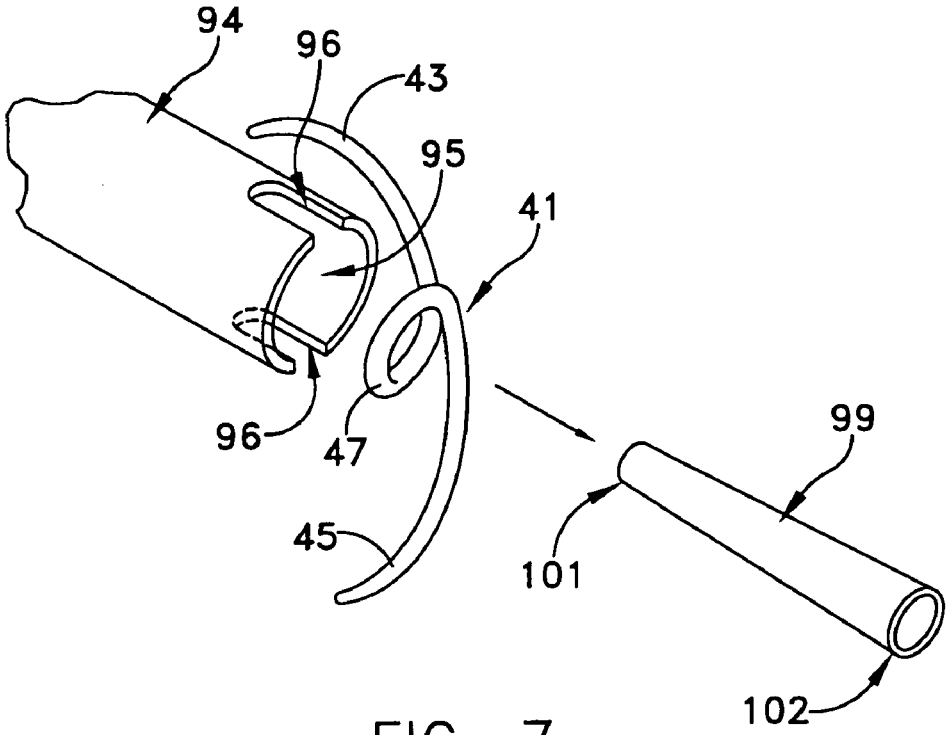
FIG. 7-10 is a series of exploded perspective views of an insertion head, torsion spring, mandrel and hollow tapered insert tube arranged in sequence in accordance with one embodiment of an assembly procedure used to form electrical contact assemblies in accordance with the present invention.
Figure 8:
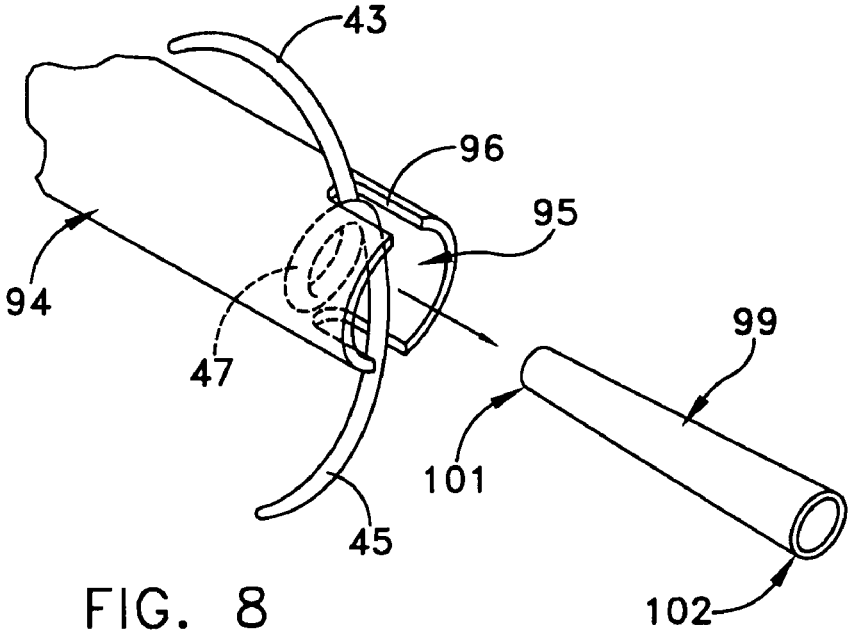

In another embodiment illustrated in FIGS. 5 and 6, a curved torsion spring 41 includes a first cantilevered arm end 43 and a second cantilevered arm 45 that each emerge from a wound section 47 of about at least one and one half turns. In this embodiment, first cantilevered arm 43 and second cantilevered arm 45 comprise a substantially arcuate or curved shape having a radius in the range from about five mils to about thirty mils. Once again, each cantilevered arm 43, 45 is cantilevered at the point along their respective lengths where each engages the outer surface of the mandrel, as will hereinafter be more fully disclosed. At least a tip portion of each cantilevered arm 43, 45 in curved torsion spring 41 forms a contact pad interface portion 53. The structural arrangement provided by curved torsion spring 41 is also relatively small in size so as to be compatible with center line spacings of five mils or less, and also exhibits a high but adjustable elastic compliance that also allows for compressive deflections of as much as thirty percent of the undeflected height of each cantilevered arm 43, 45, and with low contact forces that are routinely less than twenty grams per electrical contact assembly.

Straight torsion spring 30 and curved torsion spring 41 are often formed from hardened stainless steel, comparable other metal alloy wire having high melting temperature characteristics, hardened high temperature compatible copper alloys, or their equivalent, by conventional winding and forming methods known in the art. Importantly, the wire used to form either straight torsion spring 30 or curved torsion spring 41 should exhibit a high yield strength in the range from about 275 ksi to about 325 ksi, and most preferably 300 ksi or more.

In one preferred embodiment, a preplated vacuum melted, 304V stainless steel has been used to form either straight torsion spring 30 or curved torsion spring 41 so as to provide high service temperature capability on the order of two hundred and fifty degrees centigrade while at the same time exhibiting high durability and high cycles of touchdowns that will exceed five hundred thousand cycles. This preferred material (preplated 304V stainless steel and related alloys) also provides the high elastic compliance which avoids permanent set in contact height under repeated compressive loadings and also exhibits high fatigue strength. A preplating regimen that has been found to yield adequate results includes a two hundred microinch copper layer for conductivity/bulk resistivity improvement, followed by a fifty microinch nickel barrier layer, and finally a fifty microinch gold outer layer for a 1.5 mil diameter stainless steel wire since copper plating thickness often varies with wire diameter.

Straight torsion spring 30 and curved torsion spring 41 are often formed from wires having an average diameter from about 0.5 to about 1.5 mils (thousandths of an inch) with about 1-1.5 mil diameter wire being preferred for interconnection applications requiring center line spacing in the range of 40 mils to 50 mils. In interconnection applications requiring center line spacings of 20 mils or less, an average wire diameter from about 0.5 mils to 1 mil will be preferable. For chip attach applications, having center line spacing requirements of 10 mils or less, an average wire diameter of 0.5 mils or less is preferable. In accordance with the present invention, the ability to select a particular wire diameter from the foregoing wire diameter ranges provides the ability to selectively adjust the elastic compliance of the cantilevered arms for optimization of both spring characteristics and bulk resistance that are needed for a particular application.

The outer surfaces of each contact pad interface portion 51, 53 may also have a heavier coating of gold (greater than fifty microinches) or of another highly conductive noble metal, such as, palladium, or other highly conductive metals alloys, or other means for conducting electricity so as to further improve the mechanical durability of the wearing surfaces of straight torsion springs 30 and curved torsion spring 41.

In one embodiment, mandrel 34 comprises a cylinder including a first end 60, a second end 62, and a curved outer surface 64 (FIG. 3). Mandrel 34 is preferably formed from a structurally rigid conductor, e.g., preplated steel, copper, or their alloys, often with spring washers 36 positioned at each end to provide for elastic engagement with the internal surfaces of housing block 8 that define apertures 20. A noble metal plating is also applied to curved outer surface 64 of the mandrel to improve its overall surface contact properties. A preplating regimen that has been found to yield adequate results when the mandrel is formed from preplated steel includes a two hundred microinch or more copper layer for conductivity/bulk resistivity improvement, followed by a fifty microinch nickel barrier layer, and finally a fifty microinch gold outer layer. When the mandrel is formed from copper, a fifty microinch nickel barrier layer is applied directly to the mandrel followed by a fifty microinch gold outer layer. When assembled to the mandrel each straight torsion spring 30 or curved torsion contact 41 compressively engages outer surface 64 of the mandrel creating both mechanical and electrical contact resulting in improved electrical conduction between all of the structures of each electrical assembly 5. Electrical assemblies 5 thus provide high frequency signal transmittance of signals in a range that is greater than or equal to ten gigahertz. This arrangement also is capable of high current capacity due to its less than 10 milliohm bulk resistance.

In a further embodiment of the invention, utilizing straight torsion spring 30 or curved torsion contact 41, individual mandrels 70 (FIGS. 5 and 6) are formed from a continuous cylinder of conductive material, e.g., steel, copper, or their alloys, that has been machined or otherwise worked so as to form alternating annular ridges 75 and annular troughs 76, with end most bulkheads 78. Annular troughs 76 are sized and shaped to receive either wound sections 40, 47 of straight torsion spring 30 or curved torsion contact 41, respectively. Mandrel 70 is also coated with a noble metal plating to improve its overall surface contact properties as disclosed hereinabove in connection with mandrel 34. When assembled to the mandrel each straight torsion spring 30 or curved torsion contact 41 compressively engages outer surface 64 within an annular trough 76 of mandrel 70 creating both mechanical and electrical contact resulting in improved electrical conduction between all of the structures of each electrical assembly 5. Here again, electrical assemblies 5 thus provide high frequency signal transmittance of signals in a range that is greater than or equal to ten gigahertz. This arrangement also is capable of high current capacity due to its less than 10 milliohm bulk resistance.

A connector system 2 may be assembled in accordance with the present invention in the following manner. A plurality of electrical contact assemblies 5 (comprising either straight torsion springs 30, curved torsion springs 41, mandrel 34, or mandrel 70) are created by first manipulating a length of preplated wire, e.g., preplated 304V stainless steel, so as to form either straight torsion spring 30 or curved torsion spring 41. It should be noted that wound sections 40, 47 are sized so as to have an internal diameter that is less than the external diameter of mandrel 34 or annular trough 76 of mandrel 70. The mandrel may be formed from a continuous length of preplated material that is then cut to predetermined lengths.

Once a plurality of torsion springs have been formed, they are each place upon a mandrel (FIGS. 7-14). More particularly, each torsion spring is loaded onto an insertion tool that includes an insertion head 94. Insertion head 94 comprises an open end 95 with at least a pair of radially spaced, confronting longitudinally oriented grooves 96 that are sized and shaped to receive and releasably retain cantilevered arm 37, 39 or 43, 45 adjacent to open end 95. A hollow tapered insert 99 is sized so as to be received within open end 95 of insertion head 94, and tapers from a first diameter end 101 that is smaller than the inner diameter of wound sections 40 or 47 to a second diameter end 102 that is at least about one to two wire diameters larger than the inner diameter of wound sections 40 or 47. The internal diameter of at least second diameter end 102 of hollow tapered insert 99 is sized to snugly receive a portion of mandrel 34 or 70.

Figure 9:
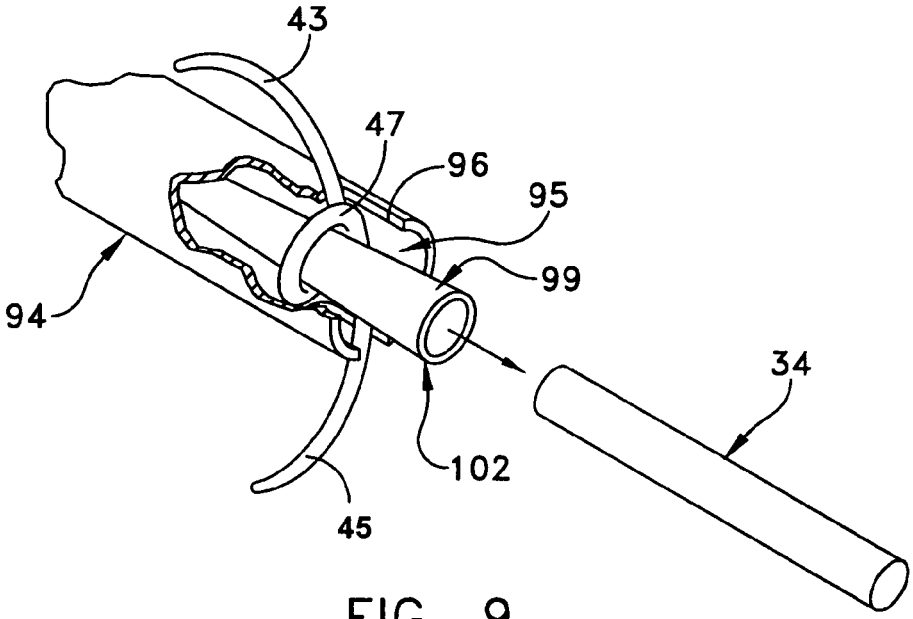
Figure 10:
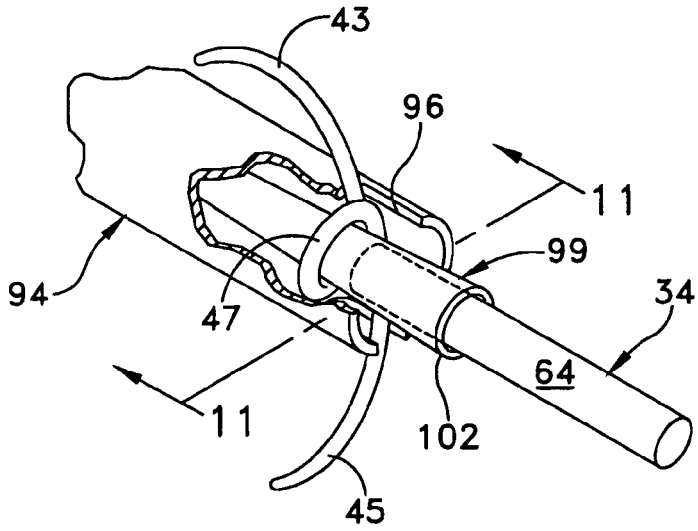
Figure 11:
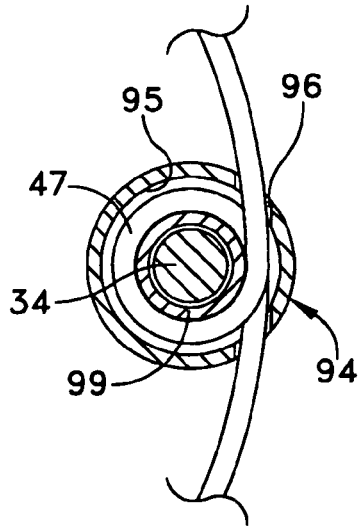
FIG. 11 is an end on view of the insertion head, torsion spring, hollow tapered insert tube, and mandrel arranged as in FIG. 10.
Figure 12:
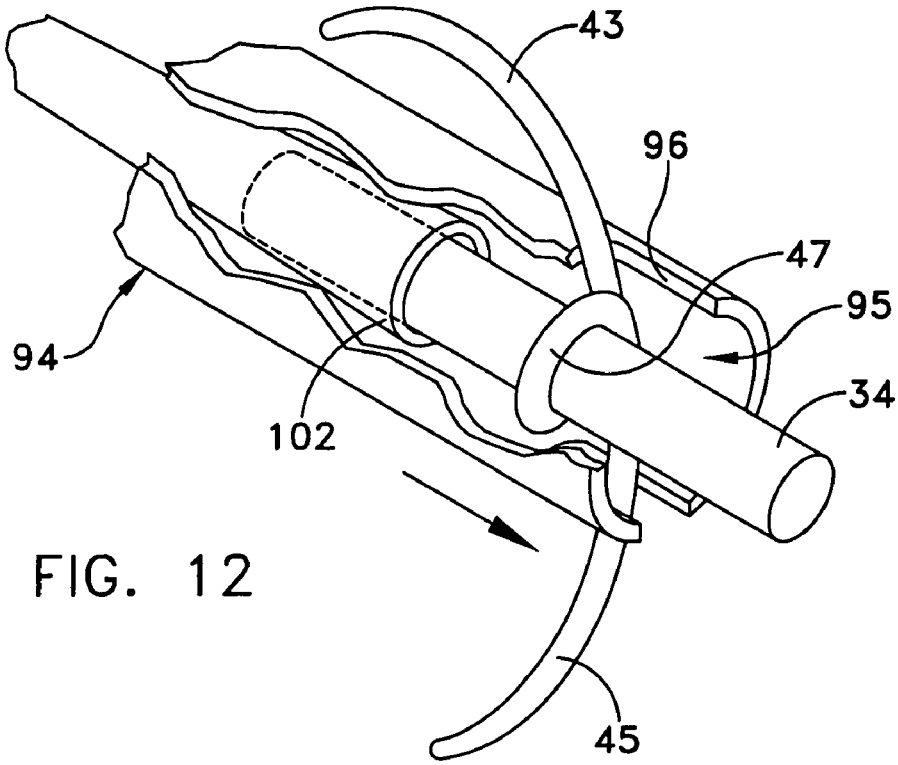
FIG. 12 is a perspective view of a fully assembled insertion head, torsion spring, hollow tapered insert tube and mandrel arranged in accordance with one embodiment of an assembly procedure used to form electrical contact assemblies in accordance with the present invention, illustrating removal of a completed electrical assembly from the insertion head.
Figure 13:
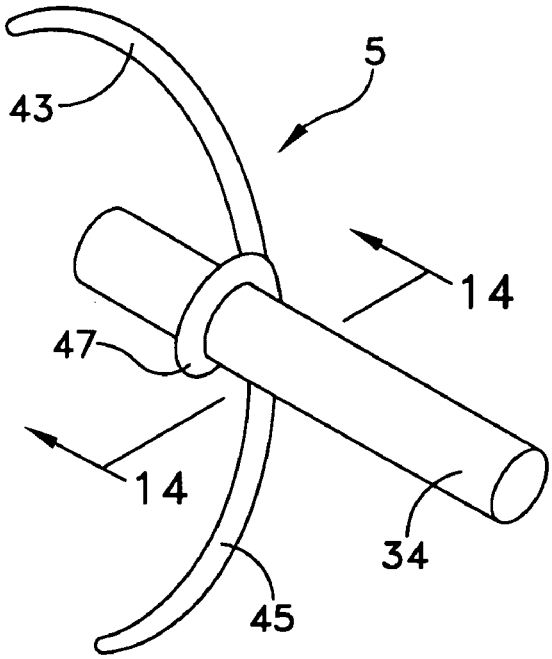
FIG. 13 is a perspective view of a fully an electrical assembly removed from the insertion head of FIG. 12.

A torsion spring is first loaded onto insertion head 94 so that free arms 37, 39 or 43, 45 are received within a respective slot 96. Once in this position, first diameter end 101 of hollow tapered insert 99 is inserted into the central opening that is defined by wound section 41, 47. As this occurs, the tapered configuration of hollow tapered insert 99 elastically expands wound section 40, 47 as the torsion spring moves from first diameter end 101 toward second diameter end 102. The torsion springs are slid back along hollow tapered insert 99 so as to expand each wound section 40 or 47 until each has an internal diameter that is larger than the outer diameter of a mandrel 34, 70. A mandrel 34, 70 is then inserted into second diameter end 102 of hollow tapered insert 99 (FIGS. 9 and 10). From this position, insertion head 94 is moved outwardly, toward second diameter end 102, so that the internal surface that defines the terminus of each slot 96 engages its respective free arm of the torsion spring. In this way, each torsion spring is slid off of hollow tapered insert 99 and onto outer surface 64 of mandrel 34 or into one of an annular trough 76 of curved torsion spring 41.

Figure 14:
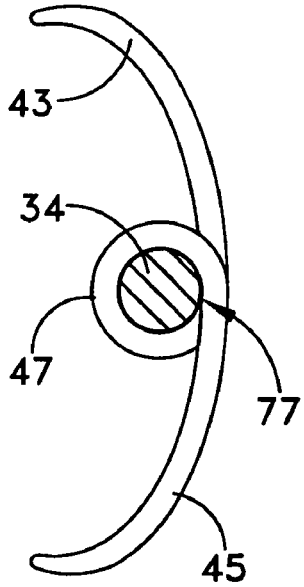
FIG. 14 is a side elevational view, partially in cross-section, of the electrical contact assembly shown in FIG. 13.
Figure 15:
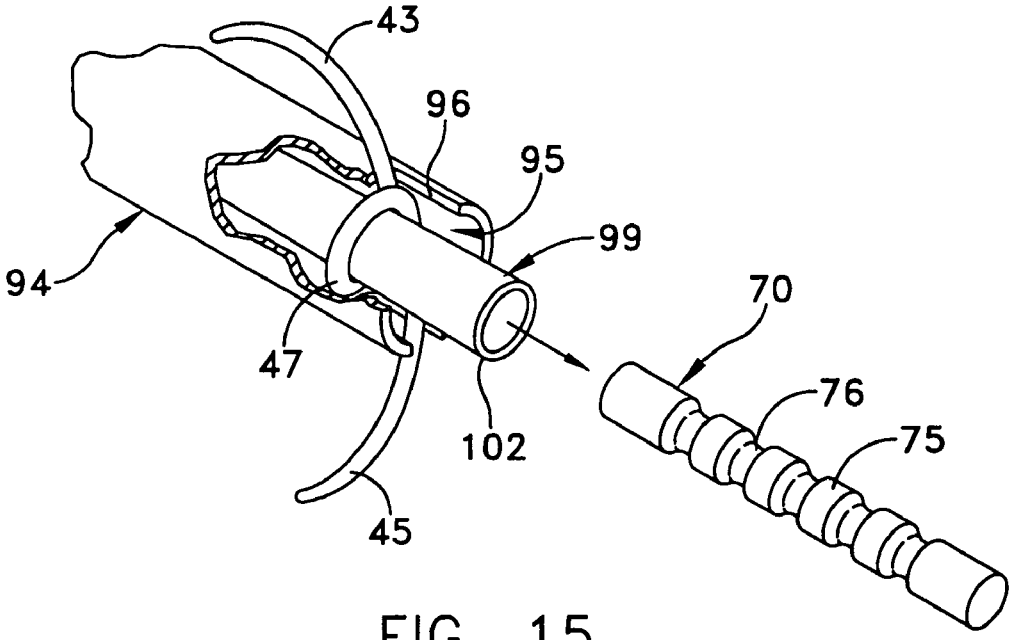
FIG. 15 is a partially exploded perspective view of an insertion head, torsion spring, and hollow tapered insert tube just prior to insertion of another embodiment of mandrel into the hollow tapered insert tube.
Figure 16:
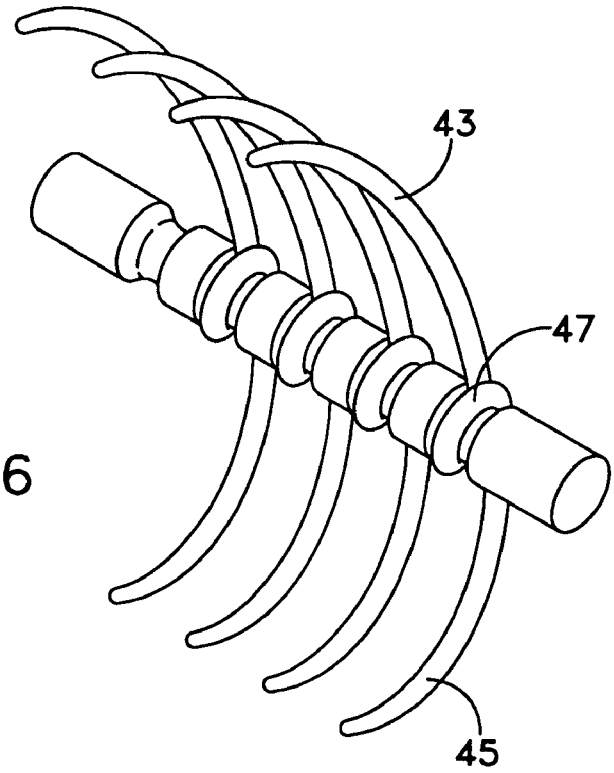
FIG. 16-20 are perspective views of a variety of electrical contact assemblies formed in accordance with a variety of embodiments of the present invention showing multiple electrical contacts assembled to single mandrels.
Figure 17:
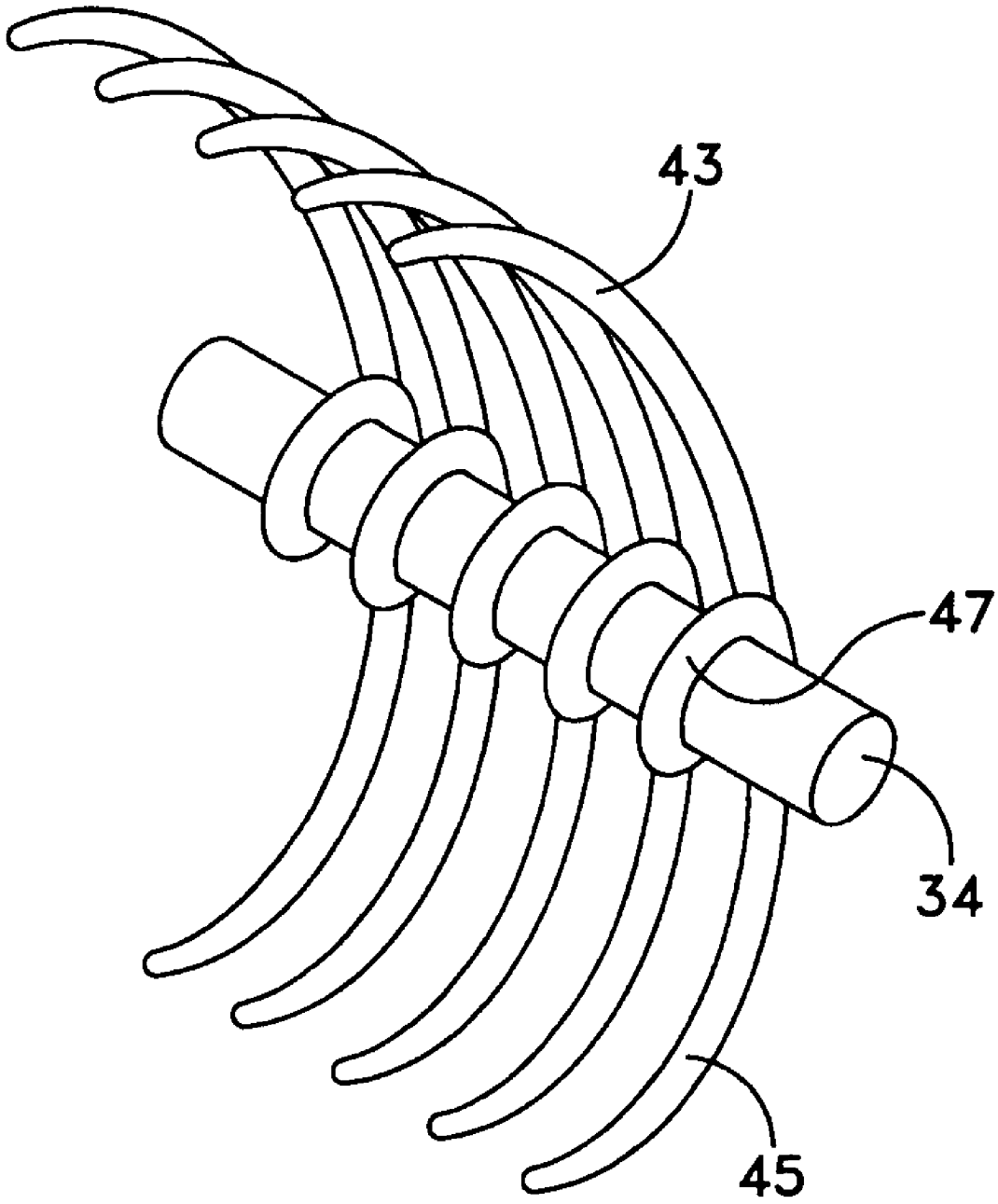
Figure 18:
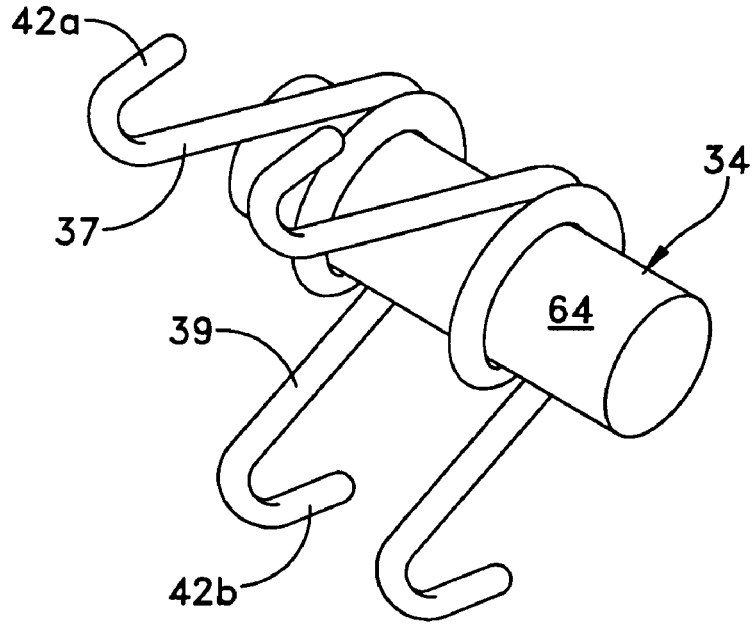
Figure 19:
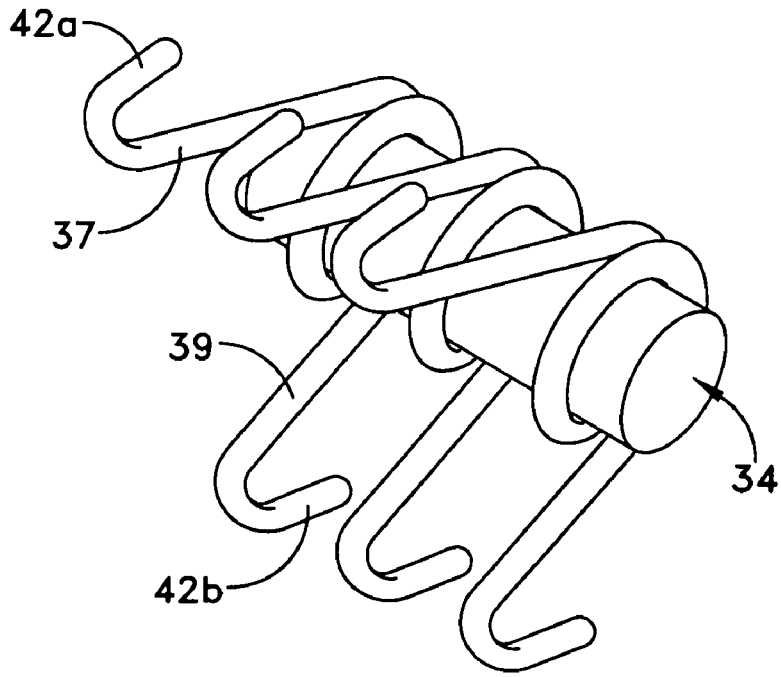

As a result, each wound section 40 or 47 of each torsion spring 30, 41 is biased outwardly by the mandrel so as to exert a contact force upon outer surface 64. In addition, since each wound section 40 or 47 is preloaded by the mandrel, each arm 37, 39 or 43, 45 acts as a cantilever that is essentially clamped at the point 77 where it engages the mandrel (FIG. 14). Although an electrical contact assembly 5 may be formed with only one torsion spring, it is preferable to have two, three, four or more torsion springs assembled to each individual mandrel in accordance with the invention so that two, three, four or more cantilevered arms engage a single contact pad (FIGS. 17-19). Advantageously, contact redundancies are provided for better reliability through the creation of parallel conduction paths between contact pads 23, 24. This construction creates both a mechanical and electrical engagement between the multiple torsion springs and the mandrel that provides electrical contact assemblies 5 with a capability for high frequency transmittance of signals greater than ten gigahertz, due to the low self-inductance created by a highly conductive short contact height. In addition, electrical contact assemblies 5 are capable of high current capacity due to a bulk resistance that is often less than ten milliohms. The less than ten milliohms that is achieved is produced by parallel contact and bulk resistances which reduce the total resistance of the electrical interconnection by dividing a normally single, high resistance by the number of contact interface resistances that are arranged in parallel, as a result of the multiple or redundant contact spring engaged with contact pads 23, 24.

Figure 20:
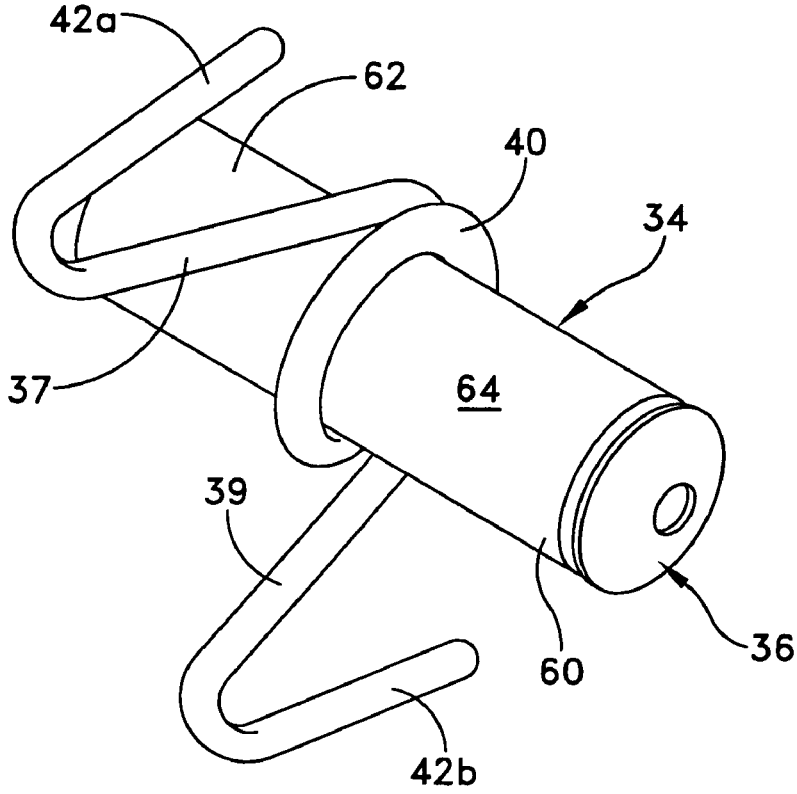
Figure 21:
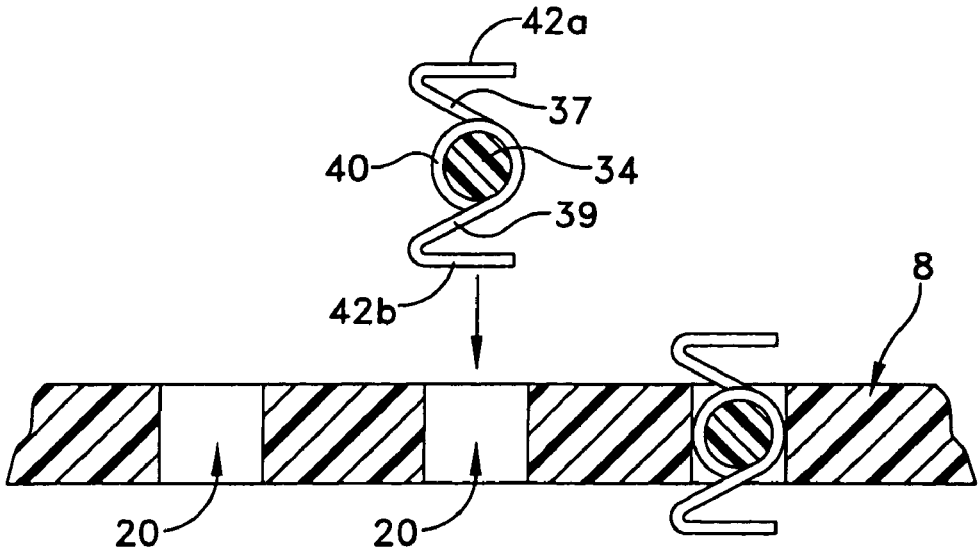
FIG. 21 is an exploded perspective view, partially broken away, of an electrical contact assembly as shown in FIG. 3 being assembled to a housing block.
Figure 22:
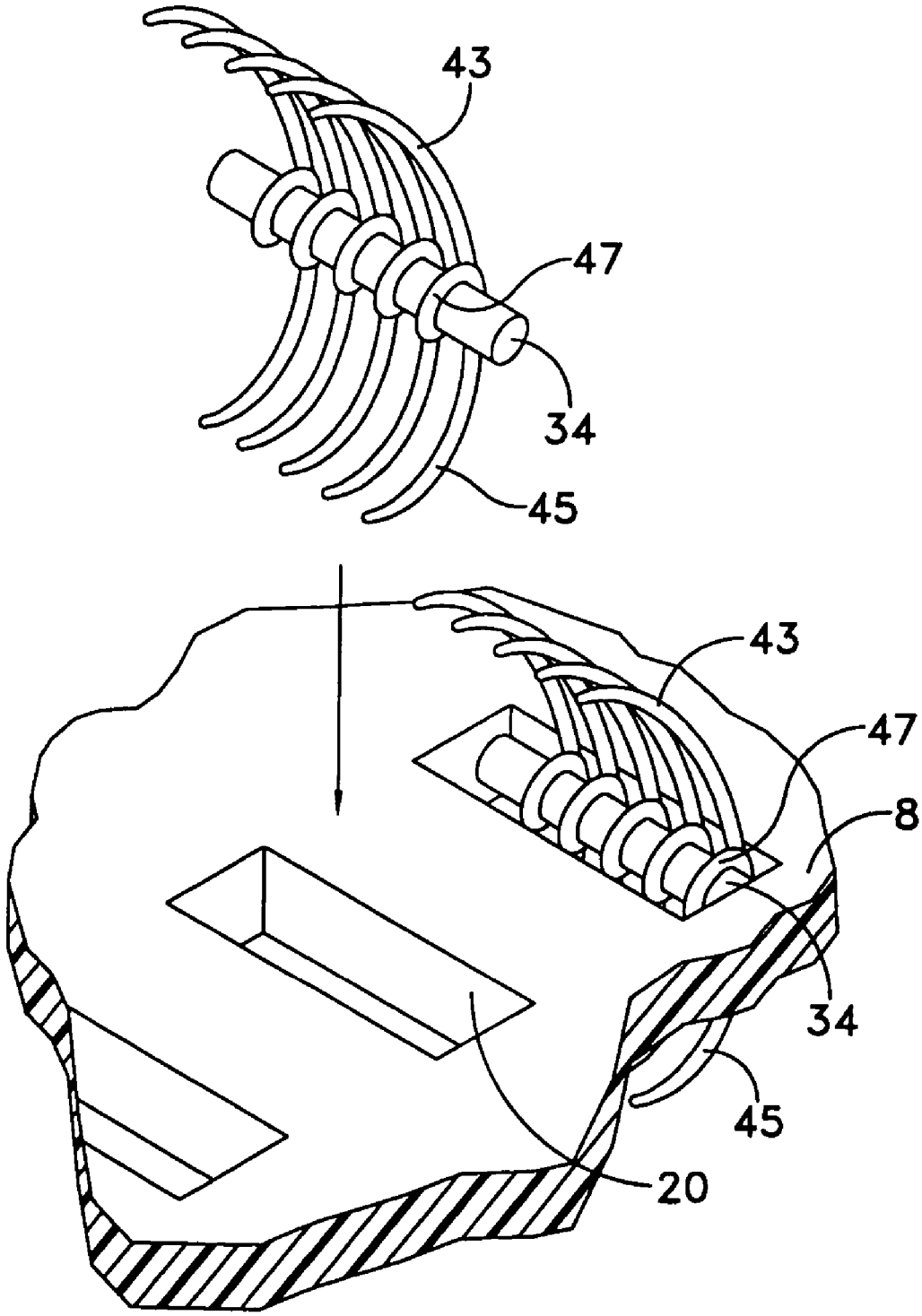
FIG. 22 is an exploded perspective view, partially broken away, of another embodiment of electrical contact assembly formed in accordance with the present invention being assembled to a housing block.
Figure 23:
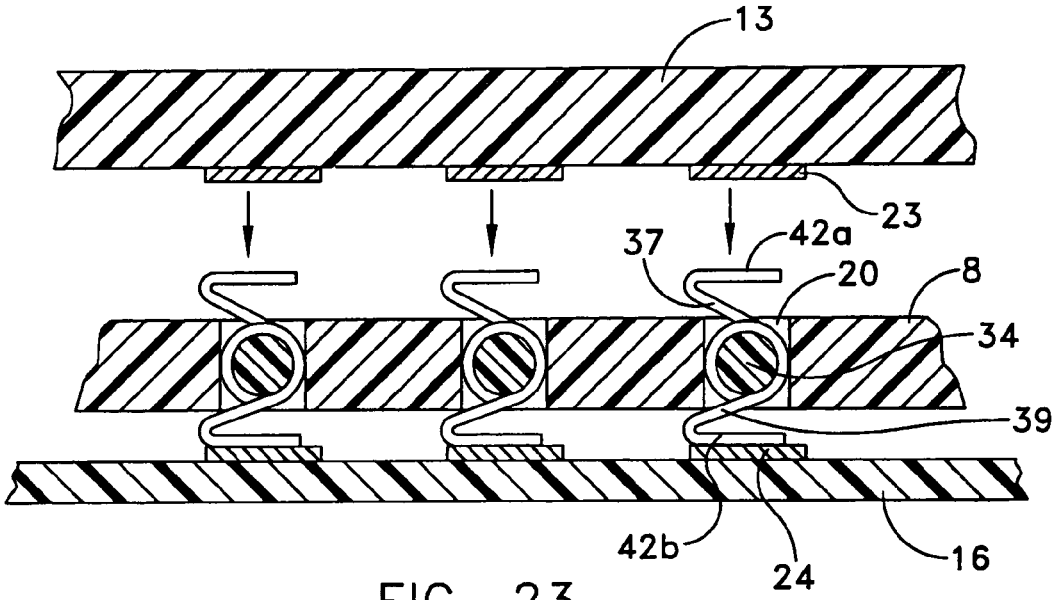
FIG. 23 is a partially broken away cross-sectional view of a connector system formed in accordance with one embodiment of the present invention during the engagement with confronting contact pads mounted on a IC and printed wiring board, respectively.
Figure 24:
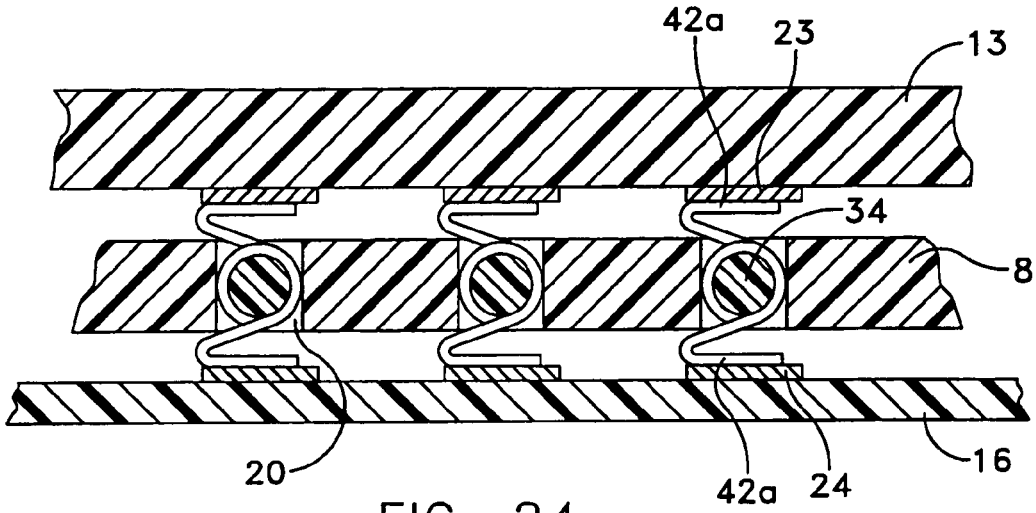
FIG. 24 is a cross-sectional view, similar to that of FIG. 23, showing engagement and deflection of the contact assemblies shown in FIG. 23.
Figure 25:
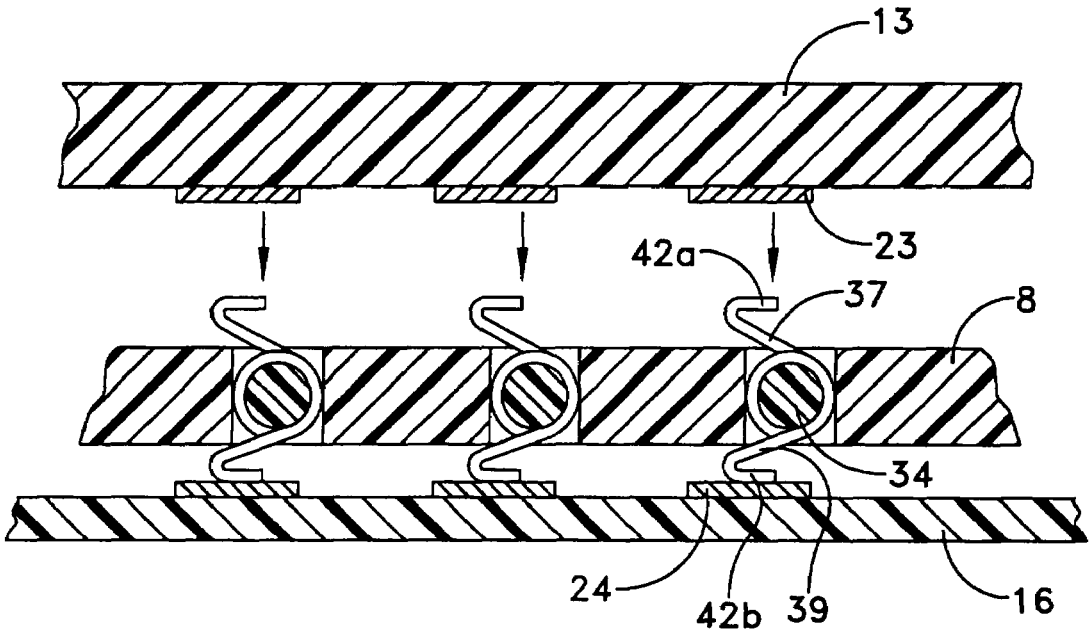
FIG. 25 is a partially broken away cross-sectional view of a connector system formed in accordance with one embodiment of the present invention during the engagement with confronting contact pads mounted on a IC and printed wiring board, respectively.
Figure 26:
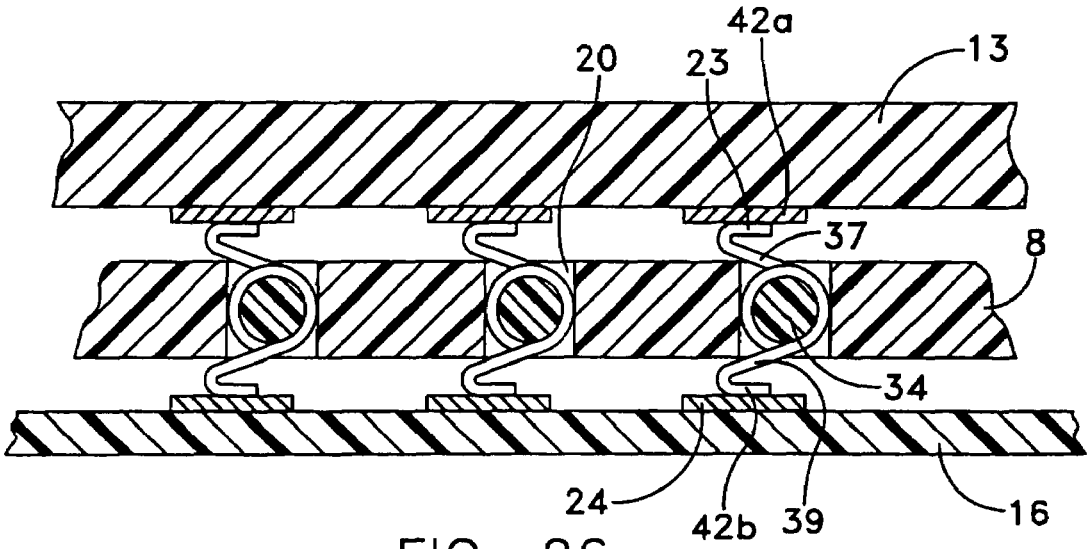
FIG. 26 is a cross-sectional view, similar to that of FIG. 25, showing engagement and deflection of the contact assemblies shown in FIG. 25.
Figure 27:
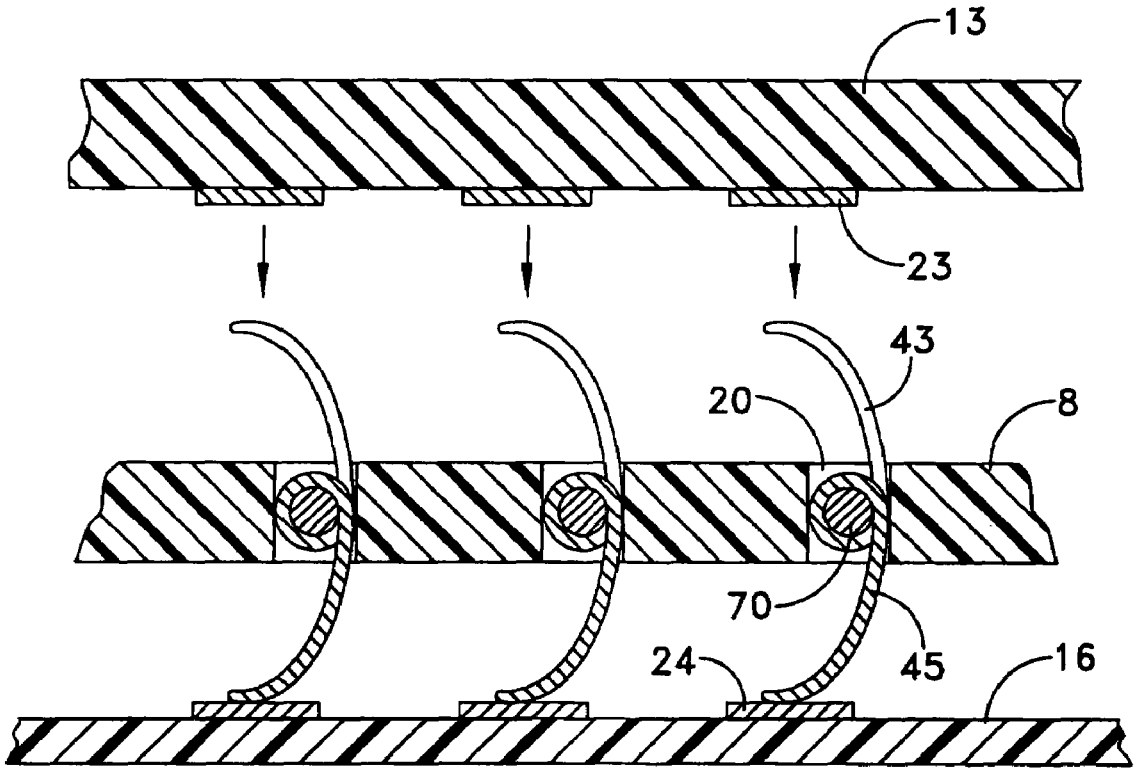
FIG. 27 is a cross-sectional view of a connector system formed in accordance with an alternative embodiment of the present invention just prior to engagement between electrical contact assemblies and a circuit component.
Figure 28:
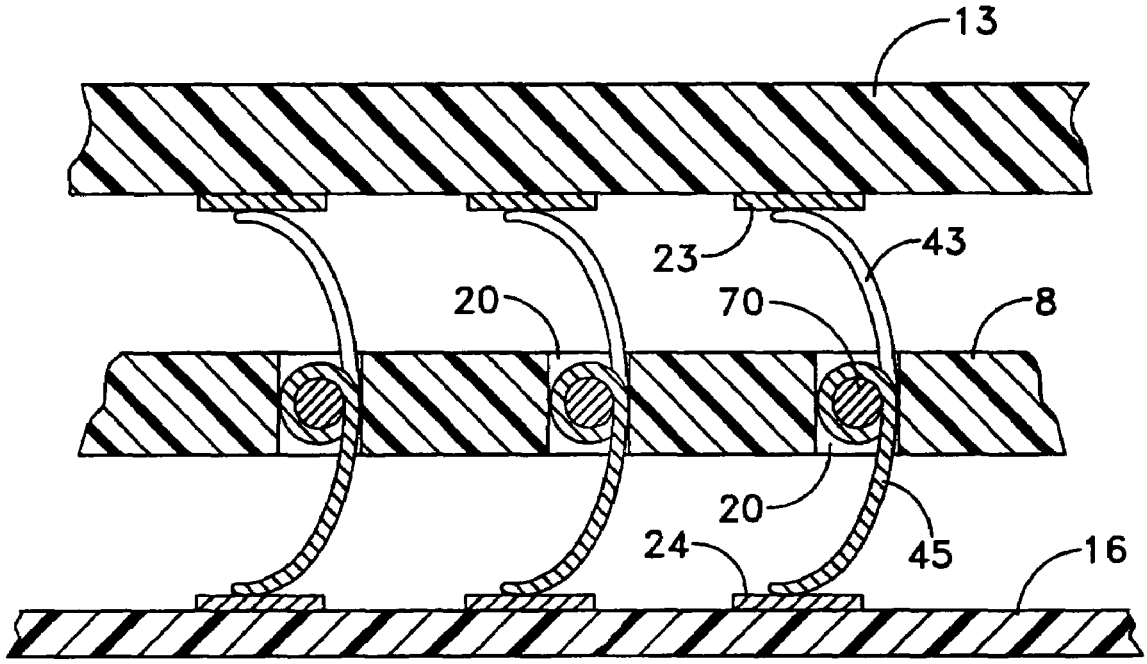
FIG. 28 is a cross-sectional view similar to that in FIG. 27 showing engagement between respective circuit components and the electrical contacts.

Referring to FIGS. 20-22, once each electrical contact assembly 5 has been formed, it may be positioned in spaced confronting relation to a corresponding aperture 20 in housing block 8. In this arrangement, free arms 39, 45 are positioned adjacent to aperture 20. Once in this position, that electrical contact assembly 5 is moved toward housing block 8 so that free arms 39, 45 enter aperture 20. As this process progresses, ends 60 and 62 of mandrel 34, for example, will enter aperture 20 and engage the interior surfaces of housing block 8 that define aperture 20. In some embodiments, resilient end washers 36, or other resilient mechanical means, e.g., a spring, will be biased between housing block 8 and the end surfaces of the mandrel so as to lodge electrical contact assembly 5 within aperture 20. In other embodiments, the mandrel itself will possess an axial resilience such that it may be wedged or lodged within aperture 20 and thereby be biased between the internal surfaces of housing block 8 that define the aperture. Once each electrical contact assembly 5 is positioned within aperture 20, the free arms of the torsion springs will stand proud of both the top and bottom surfaces of housing block 8.

Referring to FIGS. 23-28, an IC package 13 may be electrically interconnected with a printed wiring board 16 using connector system 2 of the present invention. More particularly, with a plurality of electrical contact assemblies 5 positioned within apertures 20 of a housing block 8, connector system 2 may be positioned between the bottom surface of IC 13 and a top or bottom surface of printed wiring board 16. In this arrangement, contact pads 23 of IC package 13 are positioned in confronting relation to one or more of cantilevered arms 37, 39, 43, 45 of straight or curved torsion springs 30, 41, while at the same time, contact pads 24 of printed wiring board 16 are arranged in spaced confronting relation to free arms 39, 45 of torsion springs 30, 41. Once in this position, housing block 8 may be moved toward printed wiring board 16 such that cantilevered arms 37, 39, 43, 45 make electrical and mechanical contact and engagement with the top surfaces of each of contact pads 24. It will be understood that the compound arrangement of second arms 42*a*, 42*b* and the arcuate nature of cantilevered arms 43, 45 provide for a sliding or "wiping" engagement with the contact pads which will increase electrical engagement by removing dirt or light corrosion products from those surfaces. IC package 13 is then moved toward housing block 8 so that contact pads 23, 24 engage cantilevered arms 37, 39, 43, 45 of torsion springs 30, 41.

ADVANTAGES OF THE INVENTION

Numerous advantages are obtained by employing the present invention. More specifically, an electrical contact assembly and connector system are provided which avoid the aforementioned problems associated with prior art devices. For one thing, an electrical contact assembly and connector system are provided that allows for a more simplified resilient conductive contact which incorporates the seemingly opposing requirements of good spring properties and high conductivity.

Additionally, an electrical contact assembly and connector system are provided that are extendible to a large contact array at fine pitch, i.e., five mils or less, with relatively small size, high elastic compliance, i.e., deflections of as much as thirty percent of the undeflected height of the electrical contact, and with low contact force, i.e., less than twenty grams per contact.

In addition, an electrical contact assembly and connector system are provided that are capable of high frequency transmittance of signals greater than ten gigahertz, due to low self-inductance created by a short contact height.

Also, an electrical contact assembly and connector system are provided that are capable of high current capacity, i.e., an electrical contact assembly having less than ten milliohm bulk resistance and low contact resistance.

Furthermore, an electrical contact assembly and connector system are provided that are capable of high durability or high cycles of touchdowns, i.e., greater than five hundred thousand cycles, utilizing a spring having a high elastic compliance that avoids permanent set in contact height under repeated compressive loadings and exhibits high fatigue strength.

Additionally, an electrical contact assembly and connector system are provided that are capable of high reliability with minimum degradation in contact resistance by employing a noble metal contact surface and redundancy in contact points via multiple mutually shorted circuited cantilevered beams.

Also, an electrical contact assembly and connector system are provided that are capable of high service temperatures often exceeding two hundred and fifty degrees centigrade, by employing structural parts of the electrical contact formed of high melting temperature metals, such as 304V stainless steel, that prevent the relaxation of contact force at high temperatures.

Moreover, an electrical contact assembly and connector system are provided which avoid the aforementioned problems associated with prior art devices with low cost manufacturing, using conventional high volume tools and processes.

It is to be understood that the present invention is by no means limited only to the particular constructions herein disclosed and shown in the drawings, but also comprises any modifications or equivalents within the scope of the claims.

What is claimed is:

1. An electrical contact assembly comprising a plurality of torsion springs supported in parallel upon a mandrel, the mandrel formed from a structurally rigid conductor having spring washers positioned at a first end and a second end of the mandrel and comprising alternating annular ridges and annular troughs that are sized and shaped to receive a wound section of the torsion springs each of said plurality of torsion springs comprising:

the wound section supported upon said mandrel; and the first free end and the second free end emerge from said wound section in a substantially inclined disposition relative to said mandrel;

wherein the wound section comprises at least one and a half turns and the free ends of each of said plurality of torsion springs lies at an angle of about 30° to 75° relative to a horizontal plane of said electrical contact assembly, the free ends of each of said plurality of torsion springs are emergent in substantially adjacent planes off-set from one another along a longitudinal axis of said mandrel and the free ends of each of said plurality of torsion springs include an electrical interface portion comprising a crook in each free end so as to form a compound spring.

2. An electrical contact assembly according to claim 1 wherein said free ends of each of said plurality of torsion springs comprise a substantially arcuate shape.

3. An electrical contact assembly according to claim 1 wherein said free ends of each of said plurality of torsion springs include a tip portion that forms an electrical interface portion.

4. An electrical contact assembly according to claim 1 wherein each of said plurality of torsion springs comprises a wire selected from the group consisting of hardened preplated stainless steel wire, and hardened copper alloy wire.

5. An electrical contact assembly according to claim 1 wherein each of said plurality of torsion springs comprises a wire having an average diameter from about 0.5 mil to about 1.5 mil.

6. An electrical contact assembly according to claim 1 wherein each of said plurality of torsion springs comprises a wire having an average diameter of no more than 0.5 mil.

7. An electrical contact assembly according to claim 3 wherein said electrical contact assemblies are coated with a conductive metal selected from the group consisting of gold, palladium, and platinum.

8. A connector system according to claim 1 wherein said electrical contact assemblies are coated with a conductive metal selected from the group consisting of gold, palladium, and platinum.

9. An electrical contact assembly according to claim 1 comprising at least one resilient washer located at each end of said mandrel.

10. An electrical contact assembly according to claim 1 wherein said mandrel comprises a cylinder having a first end, a second end, and a curved outer surface.

11. A connector system according to claim 1 wherein said mandrel electrically short circuits two or more of said plurality of torsion springs.

12. An electrical contact assembly according to claim 1 wherein said mandrel is made of a material having an elastic constant that produces a spring rate sufficient to provide an axial contact force when said mandrel is lodged within one of said through openings.

* * * * *